US005212895A

United States Patent [19]

Camilleri

[11] Patent Number: 5,212,895

[45] Date of Patent: May 25, 1993

[54] RETRACTABLE EXCAVATOR CUTTING TOOTH APPARATUS

[75] Inventor: Paul A. Camilleri, Queensland, Australia

[73] Assignee: Foundation Technology Limited, Nerang, Australia

[21] Appl. No.: 720,808

[22] PCT Filed: Jan. 25, 1990

[86] PCT No.: PCT/AU90/00024

§ 371 Date: Jul. 23, 1991

§ 102(e) Date: Jul. 23, 1991

[87] PCT Pub. No.: WO90/08857

PCT Pub. Date: Aug. 9, 1990

[30] Foreign Application Priority Data

Jan. 25, 1989 [AU] Australia ..... PJ2424

[51] Int. Cl.[5] ..... E02F 5/06

[52] U.S. Cl. ..... 37/80 A; 37/86; 37/191 A; 299/82; 299/85

[58] Field of Search ..... 37/80 A, 83, 86, 189, 37/191 R, 191 A, 192 R, 192 A, DIG. 16; 299/82, 85; 405/258, 267, 303

[56] References Cited

U.S. PATENT DOCUMENTS

| | | | |
|---|---|---|---|
| 1,343,081 | 6/1920 | Hammen | 37/80 A |
| 1,501,621 | 7/1924 | Ronning et al. | 37/80 A |
| 1,723,462 | 8/1929 | Boettcher | 37/189 |
| 3,319,364 | 5/1967 | Evans | 37/DIG. 16 X |
| 4,306,363 | 12/1981 | Greene et al. | 37/189 X |
| 4,834,197 | 5/1989 | Bauer et al. | 37/80 A X |

FOREIGN PATENT DOCUMENTS

| | | | |
|---|---|---|---|
| 2719160 | 11/1977 | Fed. Rep. of Germany | 299/85 |
| 434156 | 10/1974 | U.S.S.R. | 37/191 A |
| 526695 | 9/1976 | U.S.S.R. | 37/83 |
| 662665 | 5/1979 | U.S.S.R. | 37/80 A |

*Primary Examiner*—Randolph A. Reese
*Assistant Examiner*—Arlen L. Olsen
*Attorney, Agent, or Firm*—Dvorak and Traub

[57] ABSTRACT

Cutting apparatus is described which has teeth mounted on a carrier such as an endless belt or chain for advancement through material to be cut. The cutting apparatus includes a tooth mounting assembly which is supported on the carrier whereby a tooth supported thereby may be moved between an extended position at which the tooth's cutting edge extends beyond a side of the carrier and a stowed position. There may also be provided locking lugs for operatively maintaining the tooth in its extended position.

6 Claims, 12 Drawing Sheets

RETRACTABLE EXCAVATOR CUTTING TOOTH APPARATUS

FIELD OF THE INVENTION

This invention relates to retractable excavator cutting tooth apparatus.

This invention has particular but not exclusive application to retractable excavator cutting tooth apparatus for use on trenching apparatus utilised for the excavation of linear trenches, and for illustrative purposes reference will be made to such application. However, it is to be understood that this invention could be used in other applications, such as cutting slots and in block excavations.

BACKGROUND OF THE INVENTION

Trenching excavators typically utilise cutting teeth mounted on a chain or belt passing along a trenching arm to cut along an advancing face of the trench. The chain runs out of the excavation along the advancing face of the trench, and returns to its starting point through the previously-excavated part of the trench. The width of the trench produced is governed by the width of the cutter assembly mounted along the chain, and the return strand is thus a neat fit within the previously-excavated part of the trench. There is thus the inevitability of contact between the return strand and the sides of the trench, with consequent parasitic power consumption, cutter wear and damage to the trench faces. These problems are exacerbated if the trenching arm must be rotated within the trench to correct the trench alignment, or to cut a curved trench.

The present invention aims to alleviate the above disadvantages and to provide trenching apparatus which will be reliable and efficient in use. Other objects and advantages of this invention will hereinafter become apparent.

SUMMARY OF THE INVENTION

With the foregoing and other objects in view, this invention in one aspect resides broadly in retractable excavator cutting tooth apparatus having teeth mounted on a carrier for advancement through material to be cut, said cutting apparatus including:

a carrier;

a tooth mounting assembly on said carrier whereby a tooth may be mounted on said carrier for movement between an extended position and a stowed position;

a tooth supported by said mounting assembly, and holding means for operatively maintaining the tooth in its extended position. Preferably the carrier is an endless carrier such as an endless belt or chain supported on support means having spaced guide wheels or sprockets around which the endless carrier extends. The tooth mounting assembly may support the tooth for sliding movement between the extended and stowed positions.

In a preferred embodiment of the invention the tooth mounting assembly is in the form of a pivot assembly which supports the tooth for movement about a pivot axis between an extended or operative position in which the tooth overhangs the side of said carrier and a stowed position in which tooth does not overhang the side of said carrier and whereby a trench wider than the width of said carrier may be excavated. The pivot axis about which the tooth pivots may be oriented in any desired direction. For instance, the pivot axis may be inclined at a significant angle to the direction of travel of the cutting belt such that the cutting tooth may be held in the operative position by cutting forces, and whereby the cutting tooth may be moved to the stowed position by centrifugal force as the endless carrier belt passes around a tail pulley. Alternatively, the pivot axis may be disposed parallel to the direction of travel of the cutting belt such that the torque applied to pivot by the cutting forces may be minimised.

The holding means may be a rail which the tooth follows and which holds the tooth in its extended position during the movement along the advancing face of the material being cut. Alternatively, the holding means may be constituted by locking means which locks the tooth in its extended position and/or the stowed position. Suitably, the locking means is in the form of spring/ball detentes engageable with recesses. Of course, if desired, other locking means, such as frictional locking means may be provided, or the cutting tooth may be shaped such that cutting forces bias it into the operative position.

The holding means may be constituted by a fixed stop supported by the carrier and spaced longitudinally of said tooth mounting assembly and forming an abutment in the path of movement of said tooth between said extended and stowed attitudes. The arrangement is such that when the carrier passes around a guide wheel or sprocket, the bending of the carrier displaces the tooth relative to the stop sufficiently for the stop to move out of the path of movement of the tooth between the stowed and extended positions whereby the tooth may move to either position. Of course the stop moves back to its stopping position after passage around the wheel or sprocket. The stop may lead the tooth mounting assembly or it may trail same and engage with a rearward extension of the tooth.

If desired, the cutting tooth may be held in the stowed position by guide means formed on a selected portion of the belt frame supporting the cutting belt. Alternatively, the cutting tooth may be pivoted about an inclined axis and balanced such that forces due to gravity may hold the cutting tooth in the stowed position during a selected run of its travel, such as the return strand of the cutting belt.

Deployment means may be provided for moving the cutting tooth between the stowed position and the operative position at a selected location along the belt frame. The deployment means may be the aforementioned rail or the deployment means may include a lever attached to the cutting tooth and engageable with a deployment actuator which may move the lever whereby the cutting tooth may rotate about the pivot axis. The deployment actuator may include a flange on a pulley or sprocket engageable with the cutter belt or chain, a fixed guide member attached to the belt frame and adapted to converge with the path of the cutting belt, or any other desired means.

The cutting tooth may include a cutting insert attached within or about a tooth adapter formed at the outer end of the cutting tooth.

In another aspect, this invention resides in a method of cutting a trench with a trenching arm carrying an endless excavation belt, including:

providing retractable excavator cutting tooth apparatus having a pivot assembly attachable to a endless excavation belt or chain, said pivot assembly having a pivot axis substantially parallel to the direction of travel of said cutting belt, and a cutting tooth adapted for cutting material from the advancing face of a trench, said cutting tooth being pivotally mounted to said pivot assembly for movement between an operative position in which said cutting tooth overhangs the side of said endless excavation belt and a stowed position in which said cutting tooth does not overhang said side; providing deployment means for moving said cutting tooth between said stowed position and said operative position; and operating said endless excavation belt such that said deployment means moves said cutting tooth into said operative position.

In a further aspect, this invention lies in an endless excavation belt for cutting a trench, said excavation belt extending about a belt frame and including:

a plurality of retractable excavator cutting tooth apparatus each having a pivot assembly attachable to said excavation belt, said pivot assembly having a pivot axis substantially parallel to the direction of travel of said cutting belt, and a cutting tooth adapted for cutting material from the advancing face of a trench, said cutting tooth being pivotally mounted to said pivot assembly for movement between an operative position in which said cutting tooth overhangs the side of said endless excavation belt and a stowed position in which said cutting tooth does not overhang said side, and deployment means for moving said cutting tooth between said stowed position and said operative position.

The excavation belt may be of any desired construction such as an endless loop of flexible material, but it is preferred that it be formed from a plurality of rigid segments pivoted one to another along transverse pivots.

In order that this invention may be more easily understood and put into practical effect, reference will now be made to the accompanying drawings which illustrate preferred embodiments of the invention, wherein:

DETAILED DESCRIPTION OF THE PREFERRED EMBODIMENTS

Figure 1:
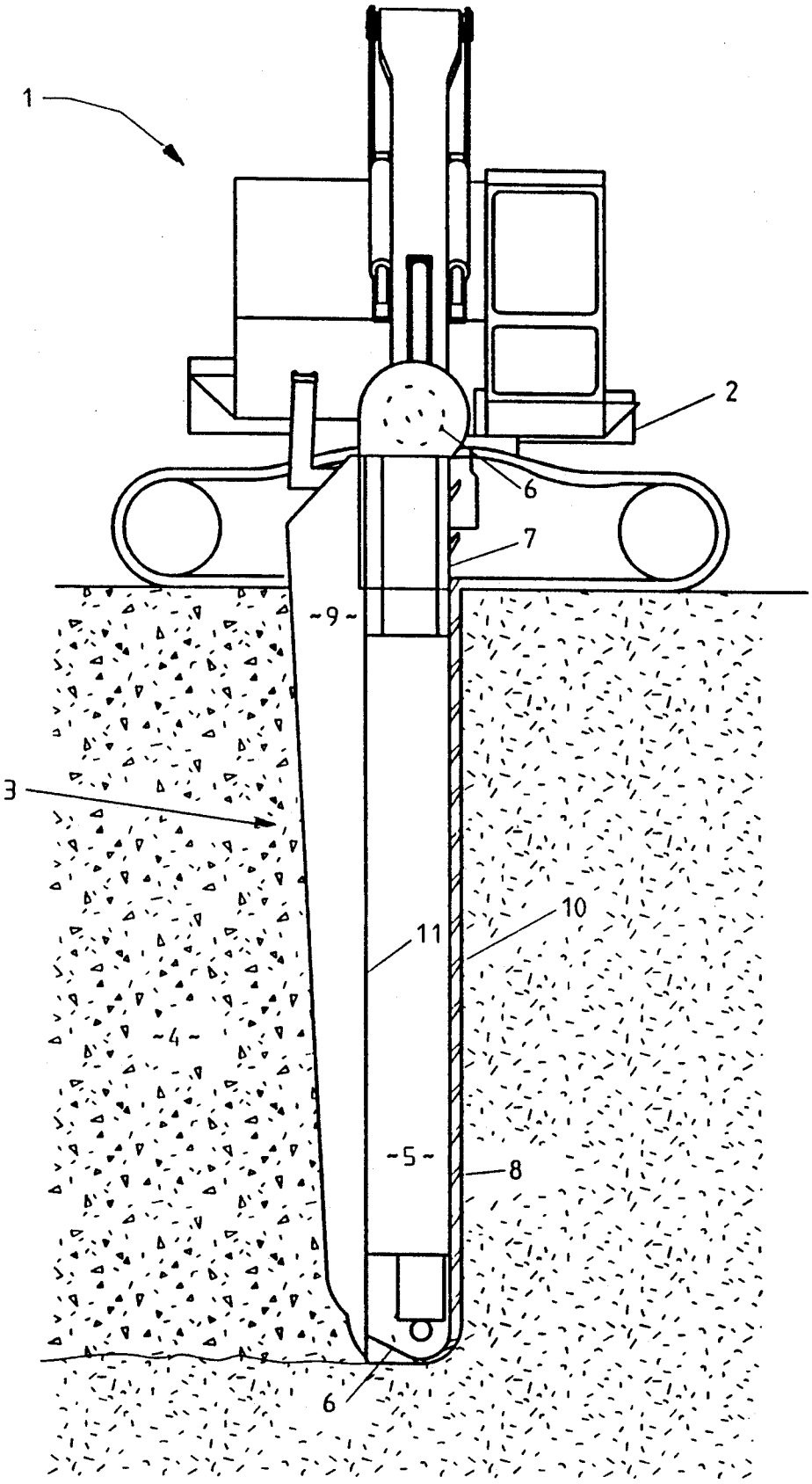
FIG. 1 is a side view of a trenching apparatus including retractable excavator cutting tooth apparatus according to the invention.

The trenching apparatus 1 shown in FIG. 1 comprises a crawler-mounted frame 2 supporting a trenching arm assembly 3 for excavation of a trench 4. The trenching arm assembly 3 includes an arm frame 5 supporting sprockets 6 about which an endless cutting chain 7 passes, the latter carrying cutting teeth 8. A concrete form 9 is attached to the rear of the arm frame 6 to provide moving formwork in which a concrete wall may be slip-formed within the trench 4. The cutting chain 7 cuts the advancing face 10 of the trench 4 by upward movement along the face 10. It will be seen that the cutting chain 7 must be narrow enough to pass between the side plates 11 which join the arm frame 5 to the concrete form 9, while cutting a wide enough face 10 to permit free passage of the arm frame 5. This may be accomplished by constructing the cutting teeth such that they may be extended transversely when cutting the face 10, and retracted when passing between the side plates 11 on the return pass down the trench 4.

Figure 3:
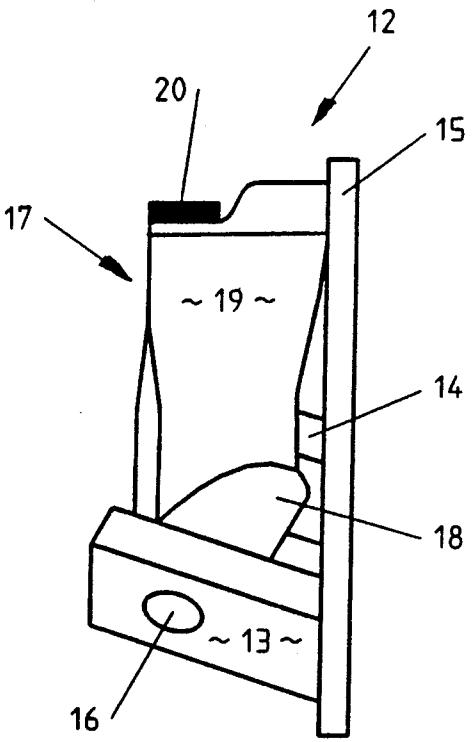
FIG. 3 is a side view of the cutting apparatus of FIG. 2.
Figure 2:
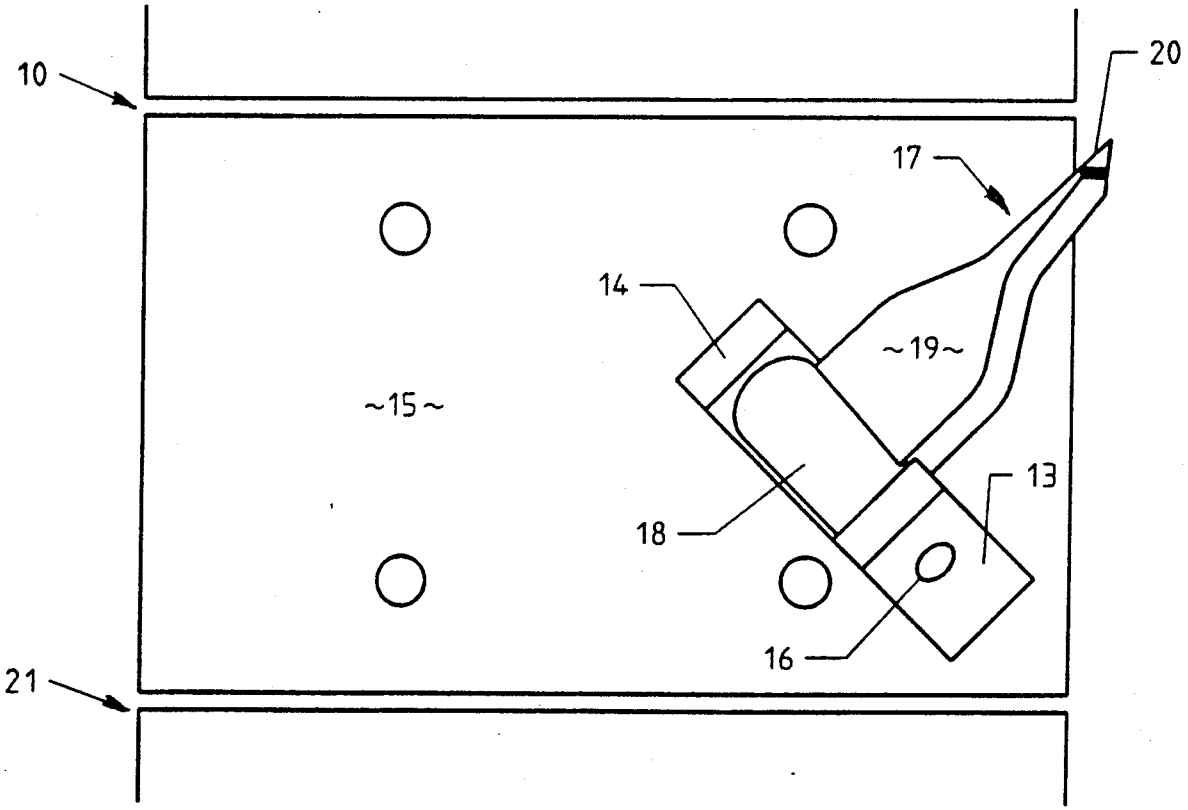
FIG. 2 is a front view of a cutting apparatus according to the invention.

The retractable excavator cutting tooth apparatus 12 shown in FIGS. 2 and 3 comprises a long pivot mounting bar 13 and a short pivot mounting bar 14 joined to a grouser plate 15 and carrying a cutter pivot shaft 16. A cutter assembly 17 comprising a pivot bush 18 and a cutter bar 19 is free to rotate about the pivot shaft 16, and carries a shaped cutting tip 20 at its outer end. Contact between the cutter bar 19 and the grouser plate 15 travel of the cutter assembly 17 beyond the extended position as shown. The axis of the cutter pivot shaft 16 is inclined to the longitudinal plane of symmetry of the grouser plate 15 at an angle between thirty and sixty degrees (preferably forty-five degrees), and is also inclined to the plane of the top surface of the grouser plate 15 at an angle between twenty and forty degrees (preferably thirty degrees).

In use, the cutting apparatus 12 is drawn around a vertical elongate trenching arm on an endless belt 21. As the cutting tip 20 encounters resistance due to digging, it is drawn into the extended operating position as shown.

When the retractable excavator cutting tooth apparatus 12 emerges from the trench, the cutting resistance is removed, and the cutter assembly 17 is free to pivot about the cutter pivot shaft 16. As the grouser plate 15 passes around an upper sprocket, centrifugal force draws the cutting tip 20 onto a larger radius about the upper sprocket, retracting it from the extended position. As the grouser plate 15 descends along the return face of the endless belt 21, gravitational forces further draw and hold the cutter assembly 17 into a stowed position with the cutting tip 20 within the transverse extents of the grouser plate 15.

As the grouser plate 15 passes around a lower sprocket, centrifugal effects draw the cutter assembly 17 into an intermediate position from which cutting resistance may move it into the extended position again. Deployment means may be provided such that the cutter assembly 17 occurs positively without reliance on cutting resistance if desired.

In the retractable excavator cutting tooth apparatus 30 shown in FIGS. 4, 5, 6 and 7, a grouser plate 31 is bolted to an endless cutting chain 32 which extends around a trenching arm 33. Pairs of axially-aligned pivot blocks 34 are attached to the side extremities of the grouser plate 31 with their pivot axes aligned with the direction of travel of the cutting chain 32. A cutter tooth shaft 35 is pivoted within each pair of pivot blocks 34, and carries a cutter assembly 36 between the pivot blocks 34.

The cutter assembly 36 is locked to the cutter tooth shaft 35, and comprises a cutter bush 37 and a cutter tooth 40 attached thereto. A cutting tip 41 is formed on the end of the cutter tooth 40 remote from the cutter bush 37.

Figure 4:
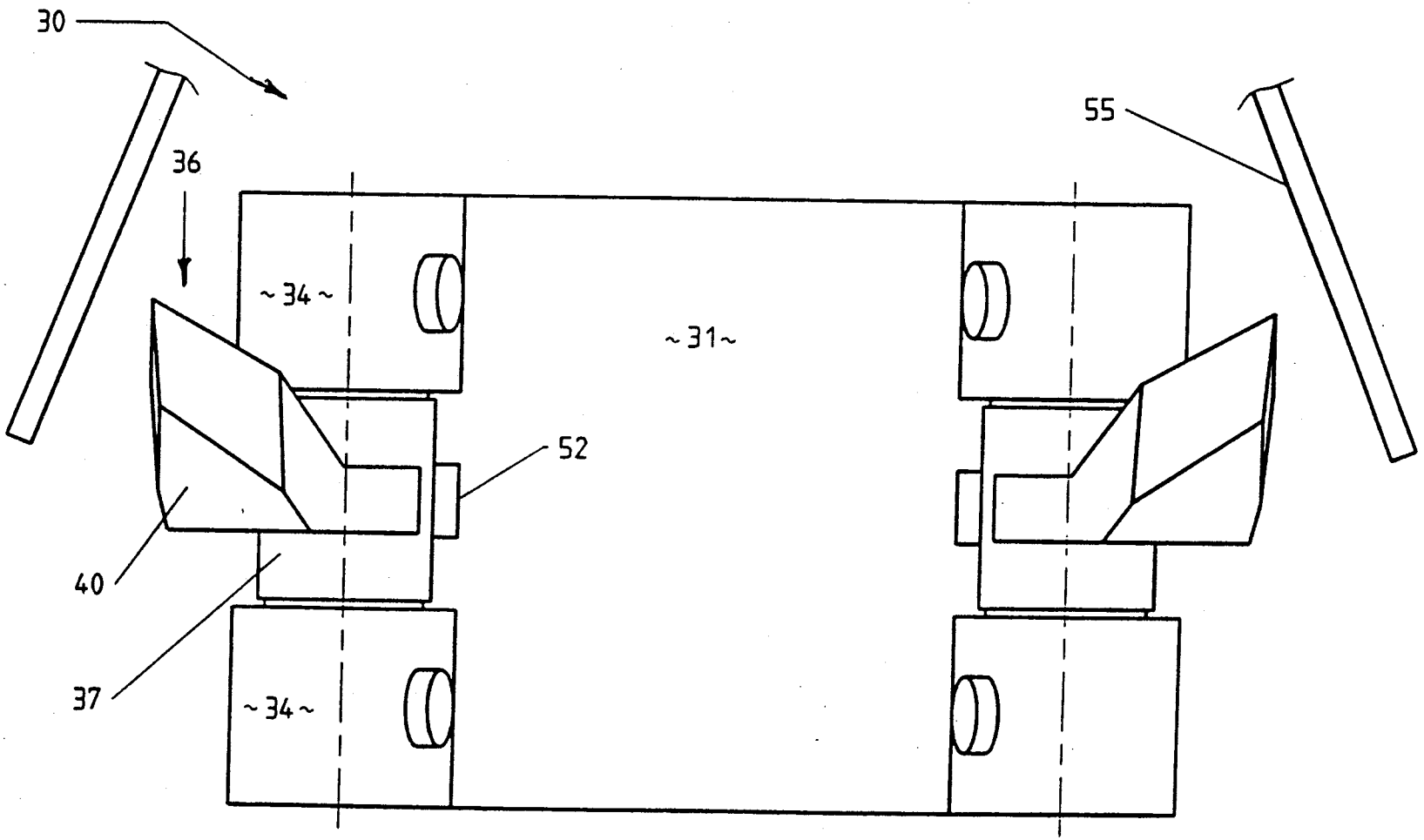
FIG. 4 is a front view of an alternative retractable excavator cutting tooth apparatus with the cutting teeth extended.
Figure 5:
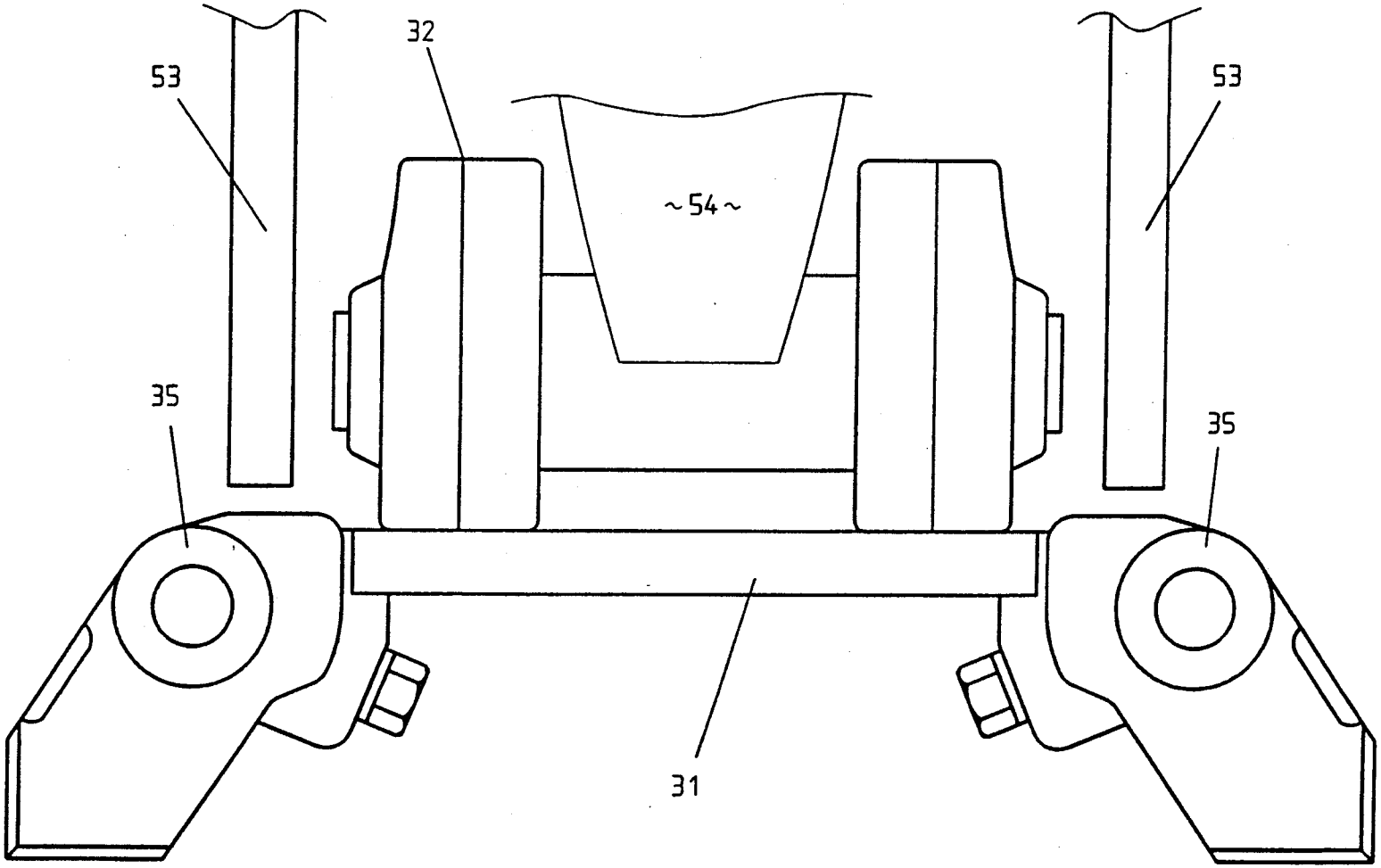
FIG. 5 is a top view of the retractable excavator cutting tooth apparatus shown in FIG. 4.
Figure 6:
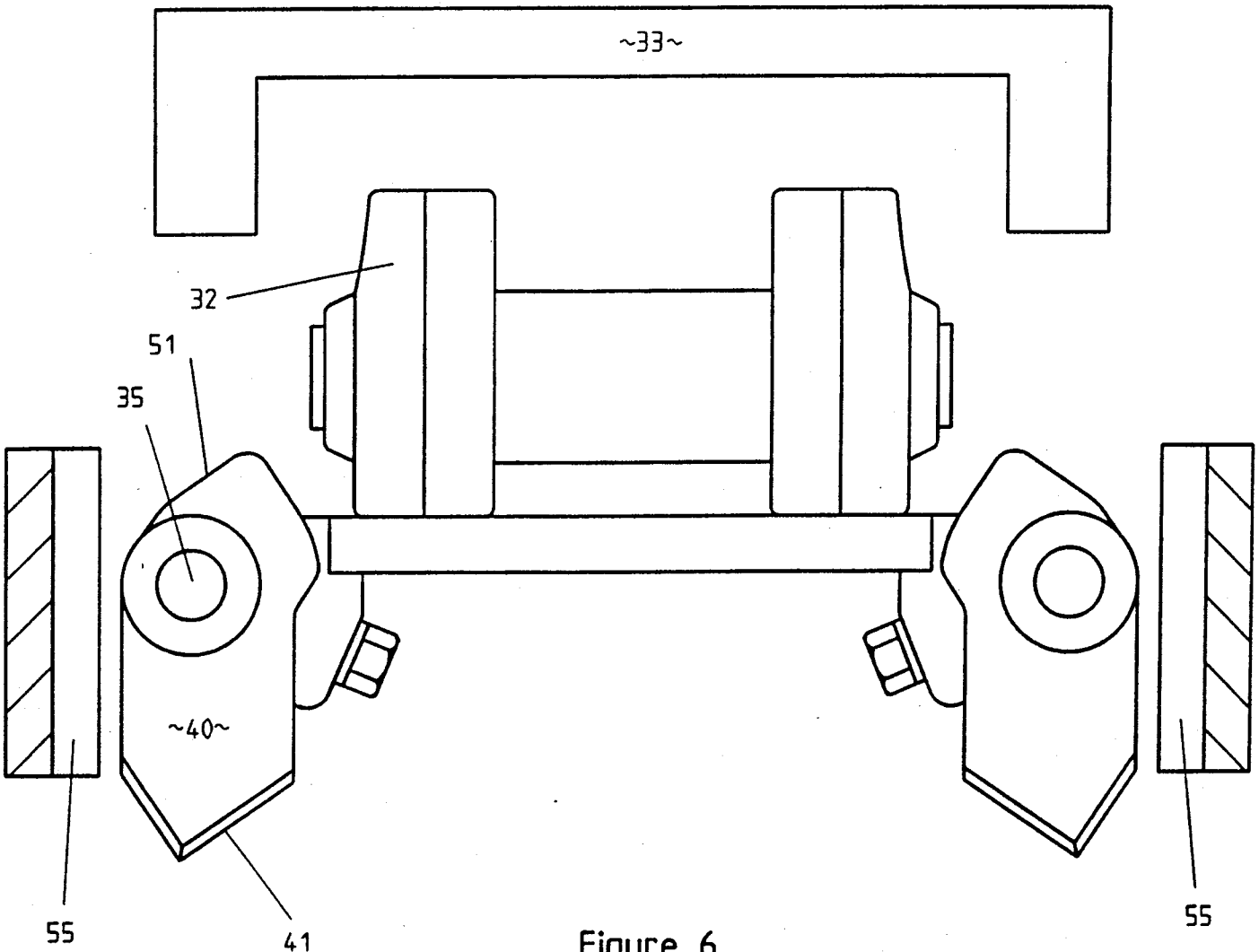
FIG. 6 is a top view of the retractable excavator cutting tooth apparatus of FIG. 4 with the cutting teeth stowed.
Figure 7:
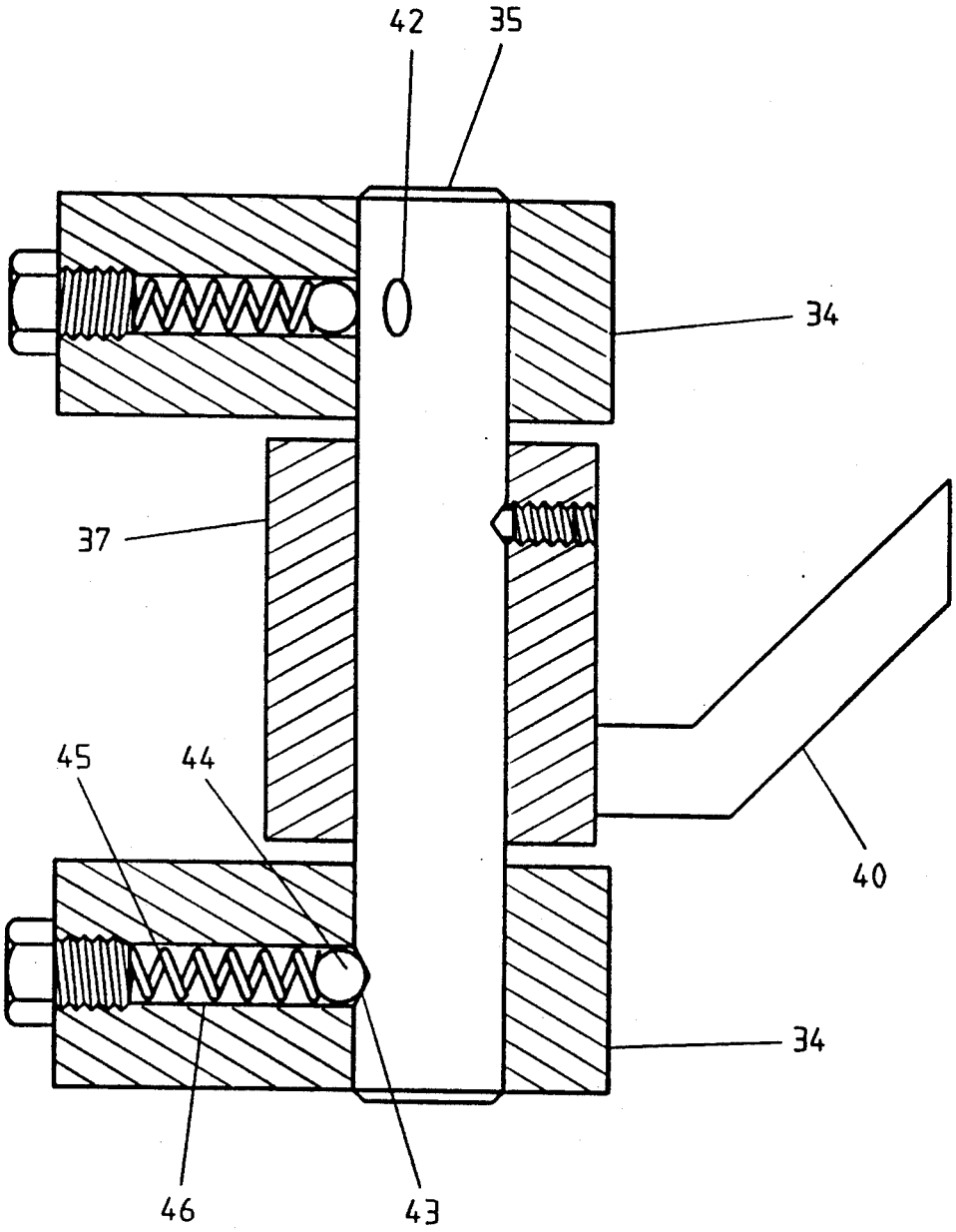
FIG. 7 is a cross-sectional view through a cutter tooth pivot from the retractable excavator cutting tooth apparatus of FIG. 4.

The ends of the cutter tooth shaft 35 which project into the pivot blocks 34 have conical indentations 42 and 43 formed therein for engagement with detent balls 44 preloaded by detent springs 45, the balls 44 and the springs 45 being enclosed within passages 46 formed in the pivot blocks 34. The indentations 42 and 43 are aligned relative to the passages 46 such that the balls 44 engage with them with the cutting tip 41 in the extended position (as shown in FIGS. 4 and 5) and the stowed position (as shown in FIGS. 6 and 7) respectively.

The cutter tooth 40 is formed with a cam 51 in its rear surface, the cam 51 extending away from the side of and through a slot 52 in the grouser plate 31 and being shaped to lie substantially co-planar with the rear face of the latter with the cutting tip in the extended position 47. The cam 51 thus extends inward beyond the rear face of the grouser plate 31 with the cutting tip 41 in the stowed position 50.

Cam actuators 53 are placed behind the slots 52 at the location along the trenching arm where it is desired to extend the cutting tips 41 and are in the form of wheel rims attached to a selected sprocket 54 supporting the cutting chain 32. Alternatively, the cam actuators may be in the form of slides fixed to the trenching arm and tapering toward the grouser plate 31 in its direction of travel. Guide plates 55 are placed beside the outer edges of the grouser plate 37 at the location along the trenching arm where it is desired to retract the cutting tips 41, and taper inward from beyond the cutting tips 41 along the direction of travel of the cutting chain 32.

In operation, the cutter assemblies 36 are initially in the retracted position, as shown in FIG. 2, as the grouser plate 37 to which they are attached passes along the return side of the trenching arm. They are held in this position by the engagement between the indentations 43 and the detent balls 44. As the grouser plate 37 reaches the sprocket 54, the cams 51 come into contact with the cam actuators 53, forcing the cutter assemblies 36 into the extended position. The shape of the cutting tips 41 produce cutting forces tending to hold the cutter assemblies extended, and engagement between the indentations 42 and the balls 44 ensures that the cutter assemblies 36 will remain extended even if the cutting forces disappear momentarily. After the cutting tips 41 have passed along the advancing face of the trench, they meet the guide plates 55 which bear against them, forcing them back into the stowed position before they pass once again along the return side of the trenching arm.

Figure 8:
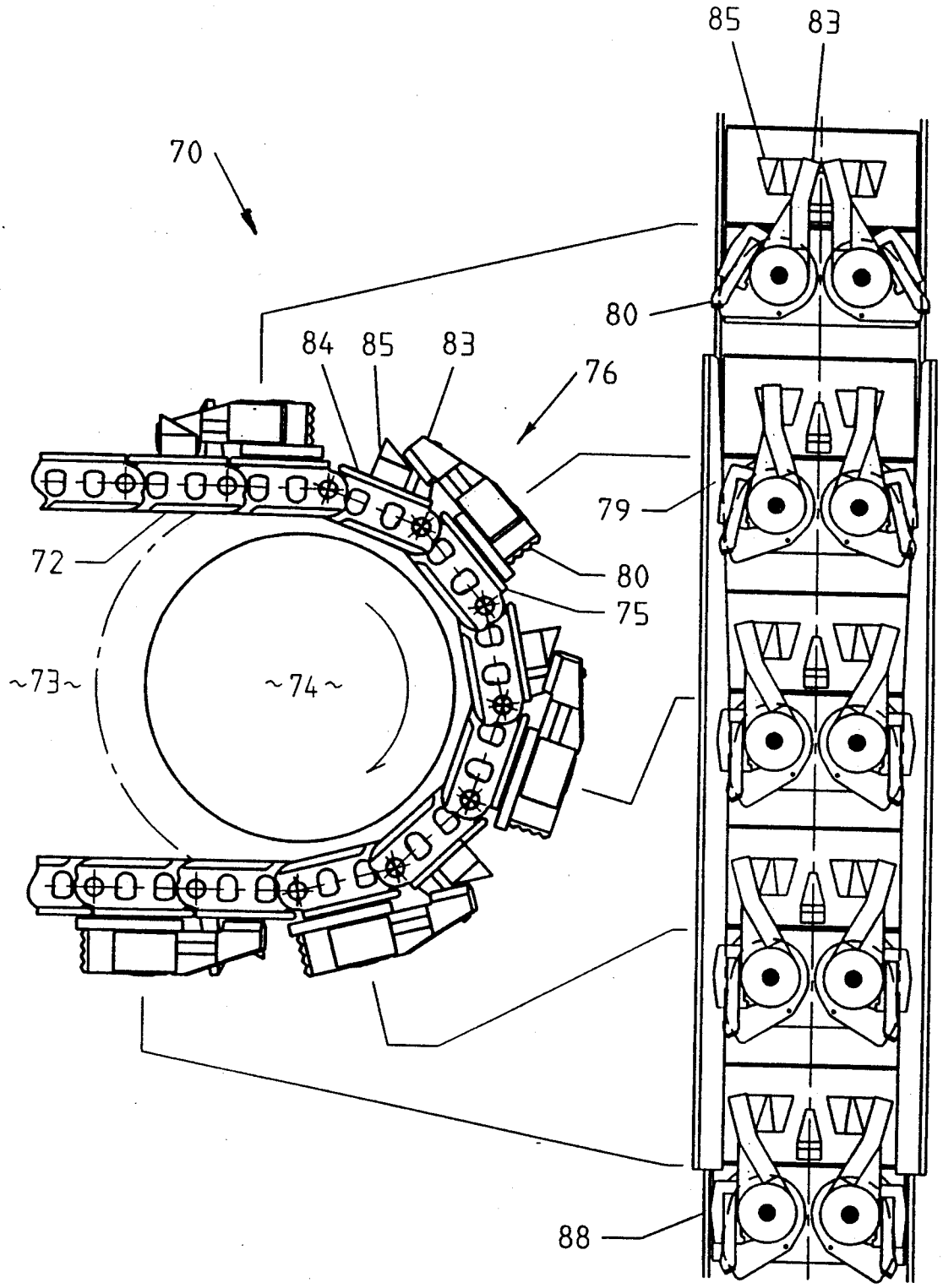
FIGS. 8 to 11 show an alternative embodiment of retractable excavator cutting tooth apparatus.
Figure 9:
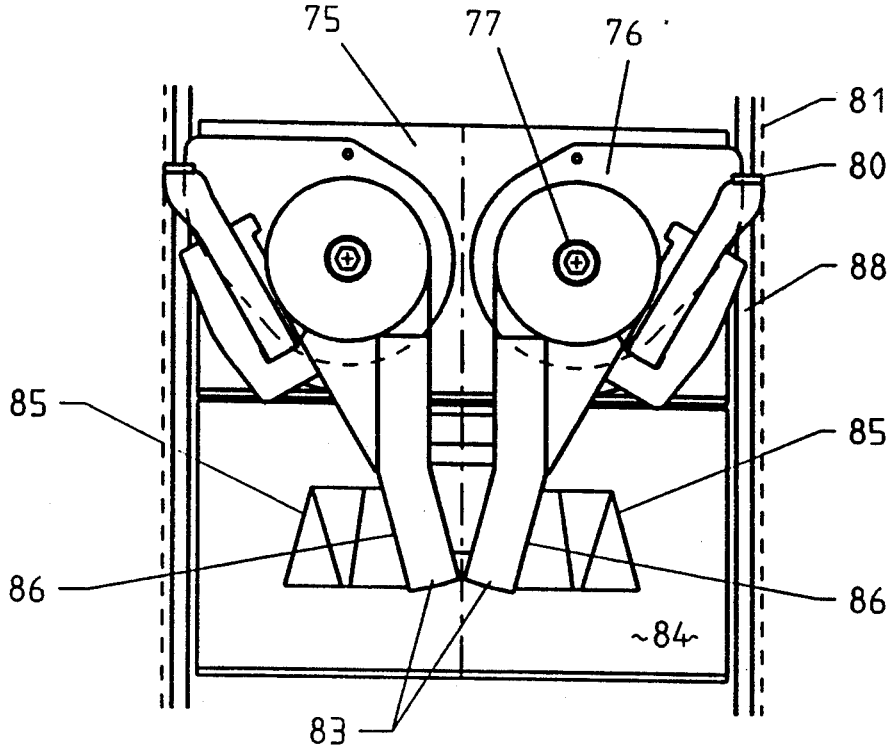
Figure 10:
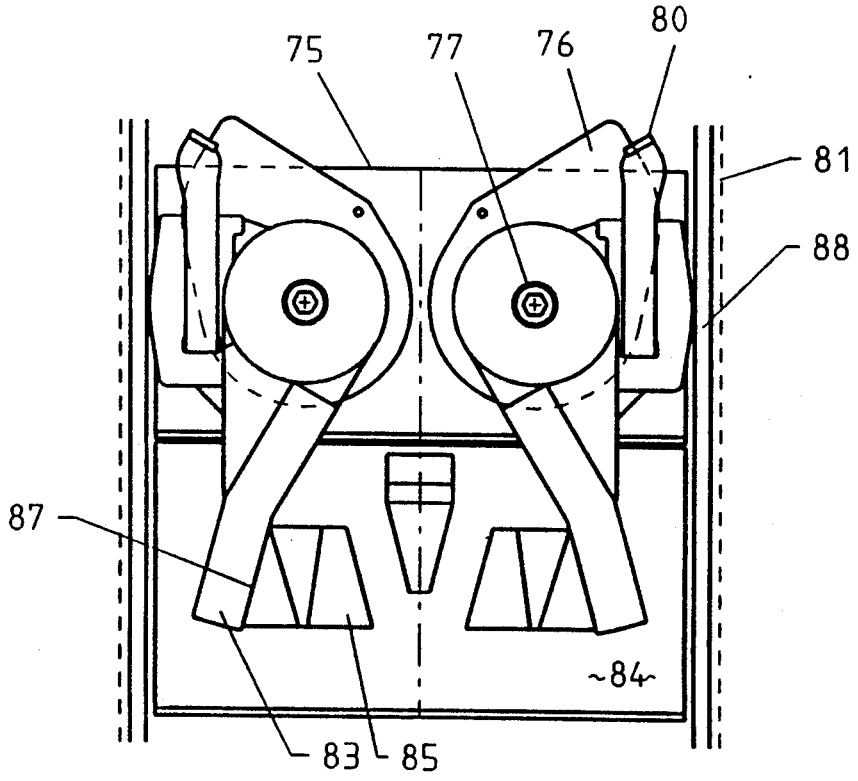
Figure 11:
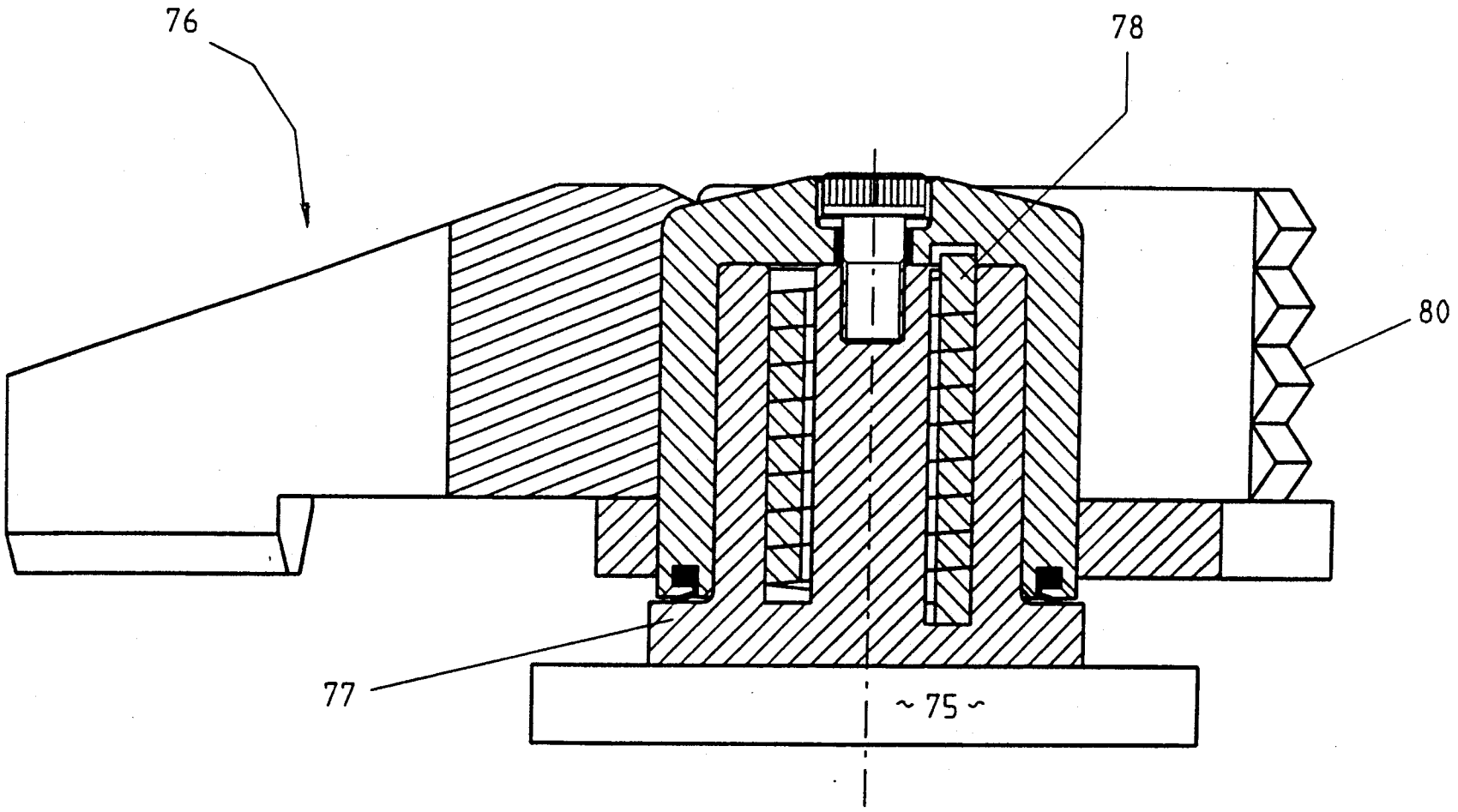
Figure 12:
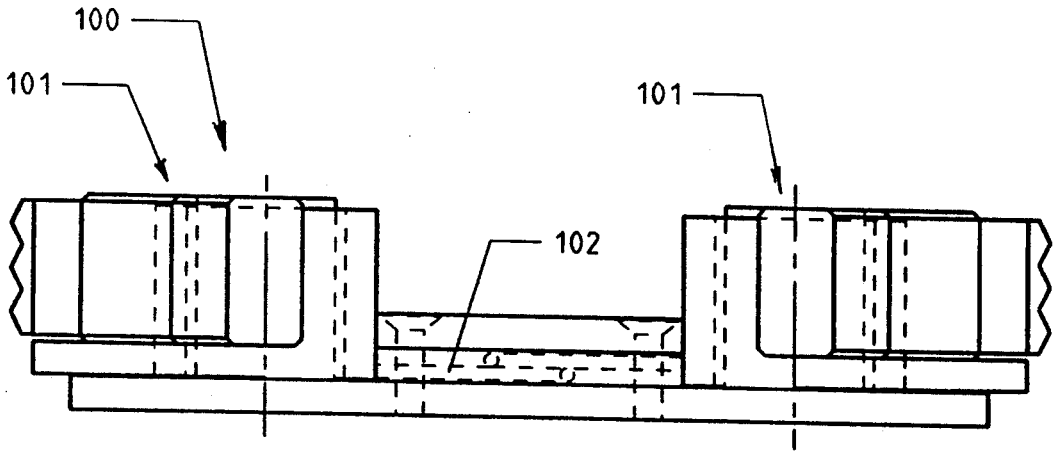
FIGS. 12 to 15 show a further embodiment of the invention.
Figure 13:
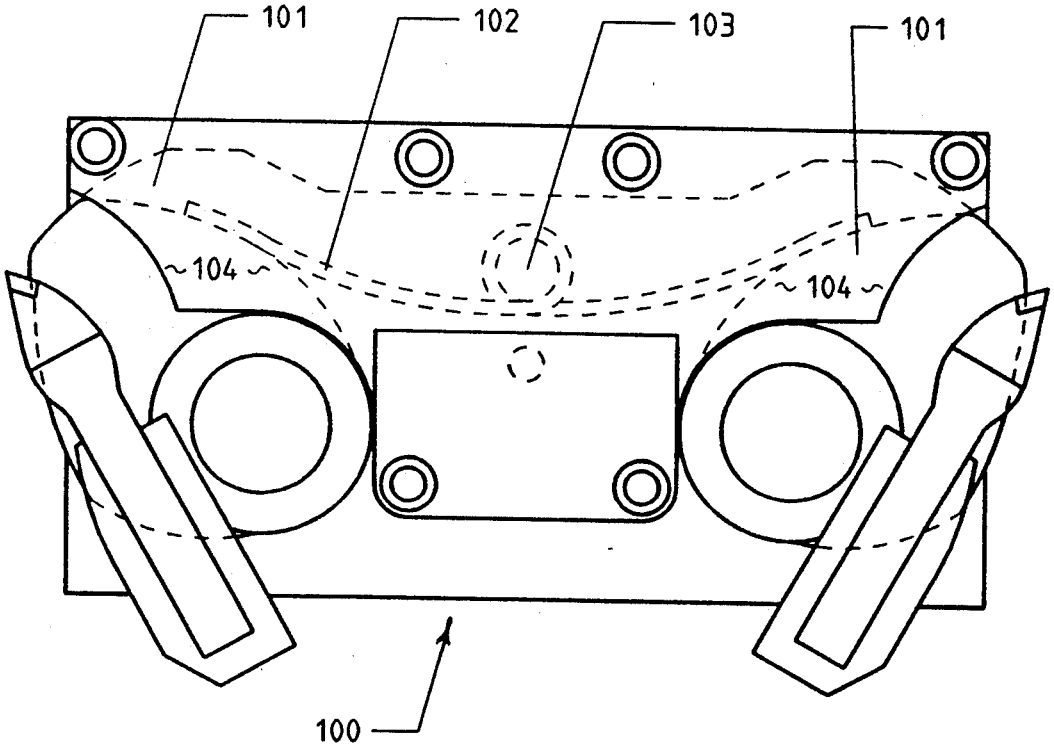
Figure 14:
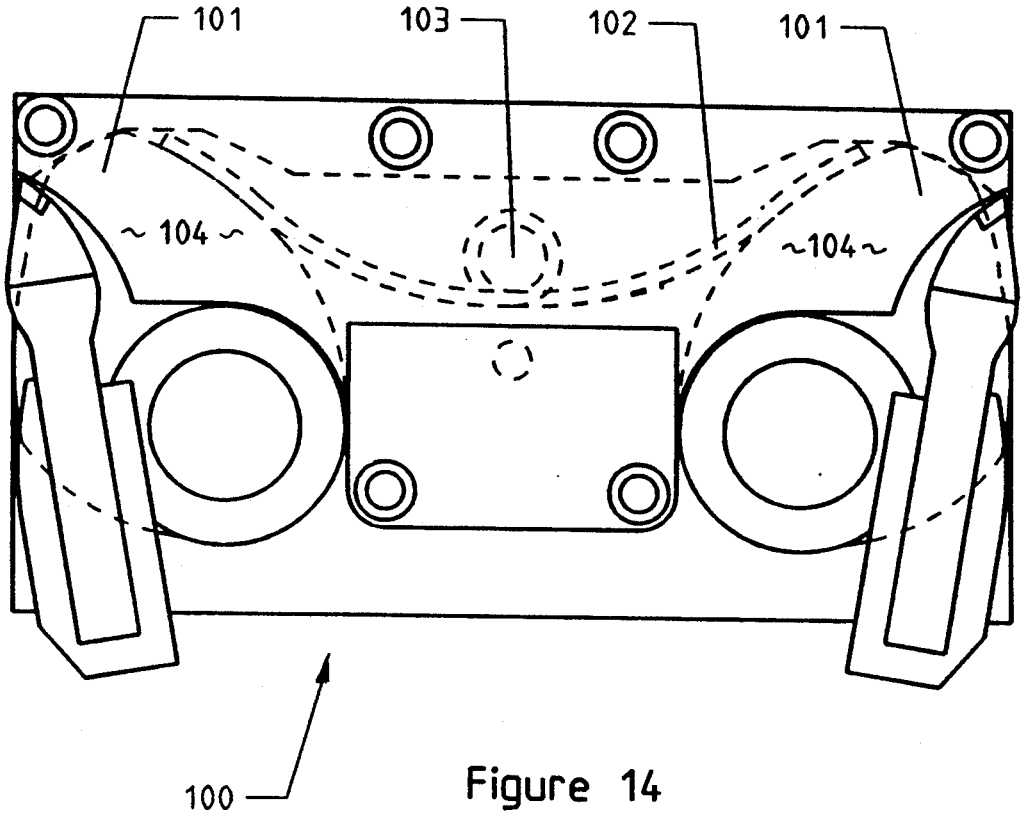
Figure 15:
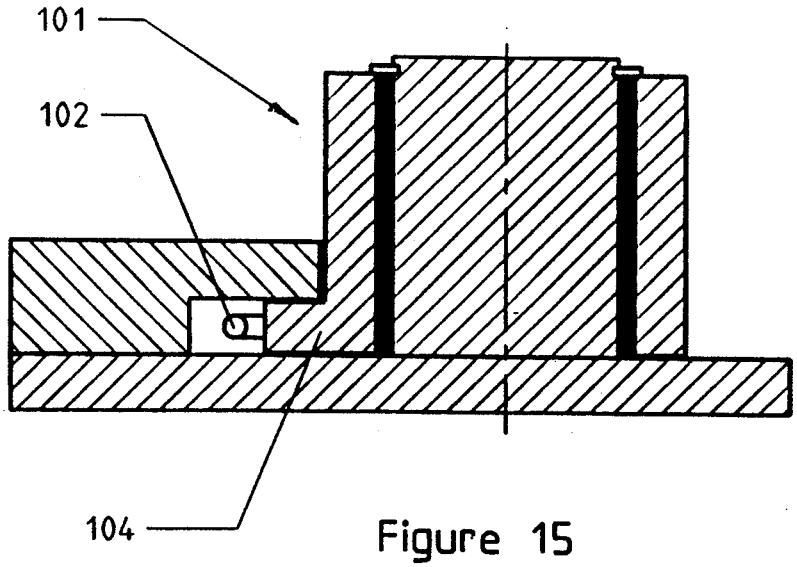

The retractable excavator cutting tooth apparatus 70 shown in FIGS. 8 to 11 comprises a cutting chain 71 consisting of links 72 and which extends along a trenching arm 73, passing about sprockets 74 at the end thereof. Alternate ones of the links 72 are cutting links 75 which support opposed pairs of cutting assemblies 76, each of which is pivoted to its cutting link 75 by a cutter pivot 77 extending away from the plane of the link 75. This allows the cutter assemblies 76 to pivot between an engaged attitude in which the cutting teeth 80 are engaged with the side walls 81 of a trench 82, as shown in FIG. 9, and a retracted attitude in which the cutting teeth 80 are withdrawn into the width of the cutting link 75, as shown in FIG. 10.

The cutting assemblies 76 include control arms 83 which extend rearwards over control links 84 which alternate in the cutting chain 71 with cutting links 75. The control links 84 include locking blocks 85 which extend above them such that, when a cutting link 75 and its trailing control link 84 are in the same plane, the control arm 83 is held to one side or the other of the locking block 85. When the control arm 83 is held to the inner side 86 of the block, the cutting teeth 80 are locked in the extended attitude, and when the control arm 83 is held to the outer side 87 of the block 85, the cutting teeth 80 are locked in the retracted attitude.

The control arms 83 are only free to pivot above the blocks 85 when the cutting link 75 and its trailing control link 84 are inclined relative to one another, as occurs when that portion of the chain 71 passes around the sprockets 74 (see FIG. 8). Torsion springs 78 interposed between the pivots 77 and the cutting assemblies 76 urge the latter into the extended attitude.

Thus, in operation, as the chain 71 is drawn around the trenching arm 73, the cutting assemblies 76 are held in the retracted attitude within the side plates 88 of the trenching arm 73 on the rear or downward run of the chain 71. As the links 75 and 84 pass around the lower sprocket 74, the control arms 83 are unlocked from the locking blocks 85, and the bias of the springs 78 urges them into the extended attitude, in which they are able to cut a trench 82 which is wider than the trenching arm 73, and in which they are locked until they reach the upper sprocket (not shown) where they are again unlocked and tapered cam rails 79 urge the control arms 83 into the retracted attitude for travel down the rear of the arm 73 between the side plates 88.

The retractable excavator cutting tooth apparatus 100 illustrated in FIGS. 12 to 15 is similar to the retractable excavator cutting tooth apparatus 70, but the biasing of the cutter pivot assemblies 101 into the extended attitude is accomplished by a leaf spring 102 mounted to a central spring pivot 103 and bearing against cams 104 formed on the lower portions of the cutter pivot assemblies 101.

Figure 16:
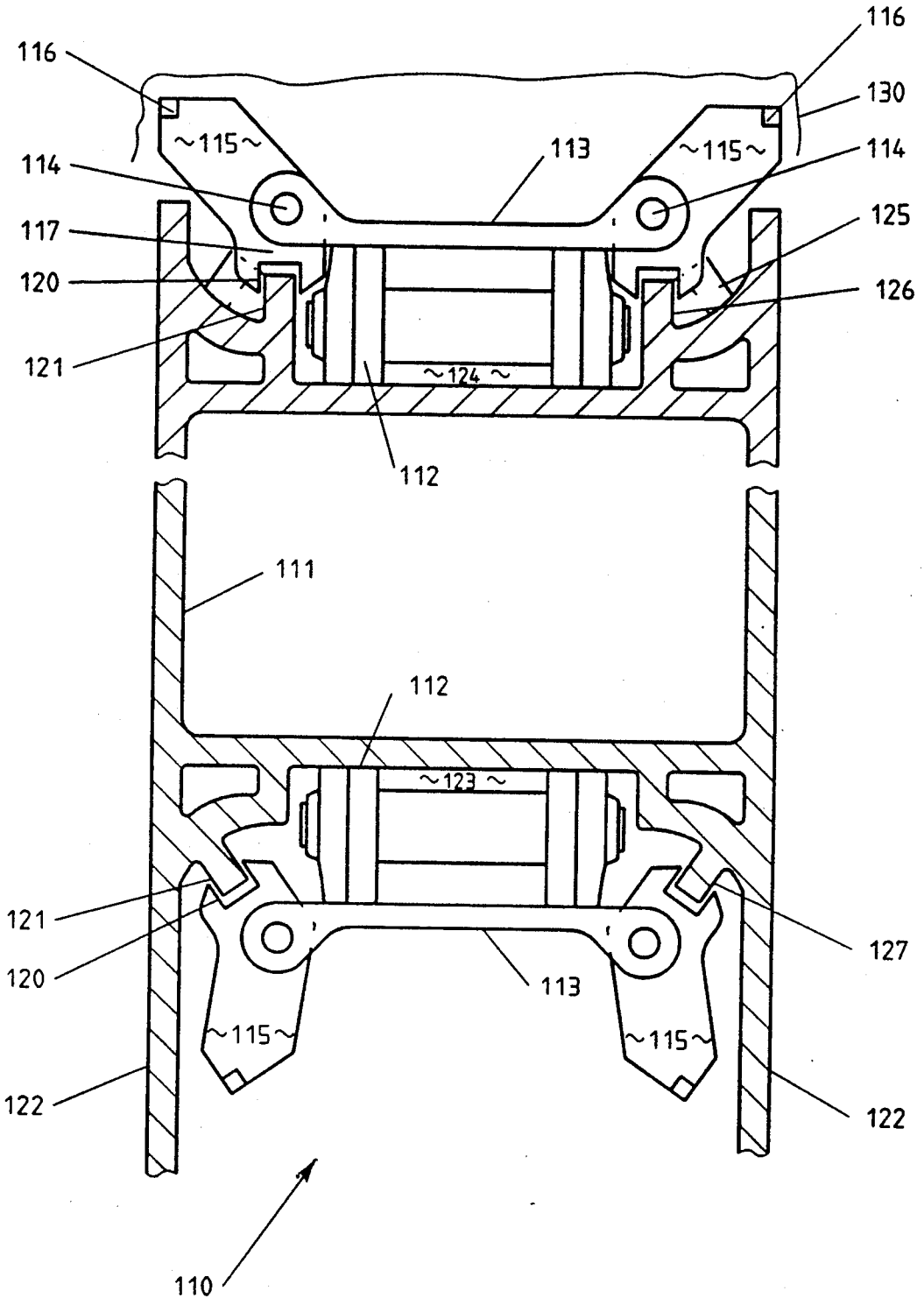
FIG. 16 illustrates yet another embodiment of the invention.

In the retractable excavator cutting tooth apparatus 110 illustrated in FIG. 16, the trenching arm frame 111 supports an endless chain 112 carrying grouser plates 113. The latter are formed with tooth pivots bosses 114 along their side edges, the axes of the tooth pivot bosses 114 being aligned with the direction of motion of the chain 112. Cutting tooth holders 115 are pivoted within the pivot bosses 114 and carry cutting tips 116 at their outer ends.

The cutting tooth holders 115 also include rearward-facing actuation portions 117 including notches 120. The latter are formed for engagement about arm flanges 121 formed along the arm frame 111. The arm flanges 121 are positioned adjacent the outer side plates 122 of the arm frame in the downward, chain return portion 123 of the trenching arm, and inboard, adjacent the chain 112, in the upward cutting portion 124 of the trenching arm. The arm flanges 121 include transition portions 125 at the upper and lower ends of the trenching arm frame 111 to form each inner flange portion 126 and the corresponding outer flange portion 127 into a continuous loop.

In use, the chain 112 is energised to draw it along the advancing face of a trench 130 with the tooth holders 115 held in the extended attitude by the interaction of the notches 120 and the inner flange portions 126. In this state, the cutting tips 116 are extended transversely and cut the trench 130 to the desired width. After the chain exits the upper extent of the trench 130, the notches 120 pass over the upper transition portions 125, drawing the tooth holders 115 into the retracted position. The interaction between the outer flange portions 127 and the notches 120 hold the cutting tips 116 within the side plates 122 for travel of the section of the chain 112 supporting the tooth holders 115 downward into the trench 130. At the bottom of the latter, the lower transistion portions 125 interact with the notches 120 to urge the cutting tips 116 into their extended cutting attitude.

It will of course be realised that while the above has been given by way of illustrative example of this invention, all such and other modifications and variations thereto as would be apparent to persons skilled in the art are deemed to fall within the broad scope and ambit of this invention as is herein set forth.

I claim:

1. A trenching apparatus having a trenching arm and an endless chain excavator having a plurality of chain link members, said chain link excavator being driven between an upper rotary guide and a lower rotary guide, said apparatus further comprising:

a body member pivotally disposed on at least one of said chain link members;

a cutting tooth disposed on said body member, said body member and said cutting tooth pivoting between a cutting position and a stowed position; and locking means for locking said tooth in said stowed position while said cutting tooth is on a return side of said endless chain excavator, said locking means disposed on a chain link member adjacent to said chain link member having said body member disposed thereon.

2. The trenching apparatus of claim 1, wherein said locking means comprises an engagement lug.

3. The trenching apparatus of claim 2, wherein said body member comprises a tongue extending over said chain link member having said engagement lug disposed thereon.

4. The trenching apparatus of claim 3, wherein said body member comprises biasing means for biasing said cutting tooth in said cutting position while said cutting tooth is on a cutting side of said endless chain excavator.

5. The trenching apparatus of claim 4, further comprising a track disposed on said trenching arm, said track applying a force to said body member against the bias of said biasing means to move said cutting tooth to said stowed position.

6. The trenching apparatus of claim 5, wherein said body member further comprises a cam, said cam engaging said track and pivoting said body member against the bias of said biasing means, said tongue engaging said engagement lug when said cutting tooth is in said stowed position.

* * * * *